United States Patent [19]

Greenwald, Sr. et al.

[11] Patent Number: 4,477,220

[45] Date of Patent: Oct. 16, 1984

[54] METHOD AND APPARATUS FOR UNLOADING BURDEN FROM A TOW COMPRISED OF BARGES

[75] Inventors: Edward H. Greenwald, Sr., McMurray; William P. O'Malley, Pittsburgh; Ross Rogers, Jr., Moon Township, Allegheny County, all of Pa.

[73] Assignee: Eavenson, Auchmuty & Greenwald, Coraopolis, Pa.

[21] Appl. No.: 372,944

[22] Filed: Apr. 29, 1982

[51] Int. Cl.[3] ..... B63B 27/00; B65G 63/02

[52] U.S. Cl. ..... 414/139; 114/251; 414/786

[58] Field of Search ..... 414/137, 138, 139, 337, 414/394, 786; 114/77 R, 230, 249, 250, 251; 440/33, 34

[56] References Cited

U.S. PATENT DOCUMENTS

| | | | |
|---|---|---|---|
| 3,104,766 | 9/1963 | Sasadi | 414/139 |
| 3,362,546 | 1/1968 | Sale | 414/139 |
| 3,420,388 | 1/1969 | Briggs | 414/139 |
| 3,497,054 | 2/1970 | Van Kleunen | 414/139 X |
| 3,770,145 | 11/1973 | Uhrich | 414/139 |

*Primary Examiner*—Leslie J. Paperner

*Attorney, Agent, or Firm*—Thomas H. Murray; Clifford A. Poff

[57] ABSTRACT

The burden from a tow of breast-tied strings of barges is unloaded by first mooring the tow to an access platform. The hard ties are removed from a first and then remaining string of barges after they are pulled against the platform. The barges of each string are provided with forward and aft soft ties and soft ties are provided between the forward and aft ends of successive strings. The softly-tied barges are advanced along a floating slip by a barge haul below two serially-arranged excavators. The burden is unloaded in two layers from each barge with each excavator removing one layer while the barges normally pass in only one direction continuously through the slip. After unloading, the empty barges are moored at a fleeting area where a tow is again formed by hard tieing the barges together.

10 Claims, 6 Drawing Figures

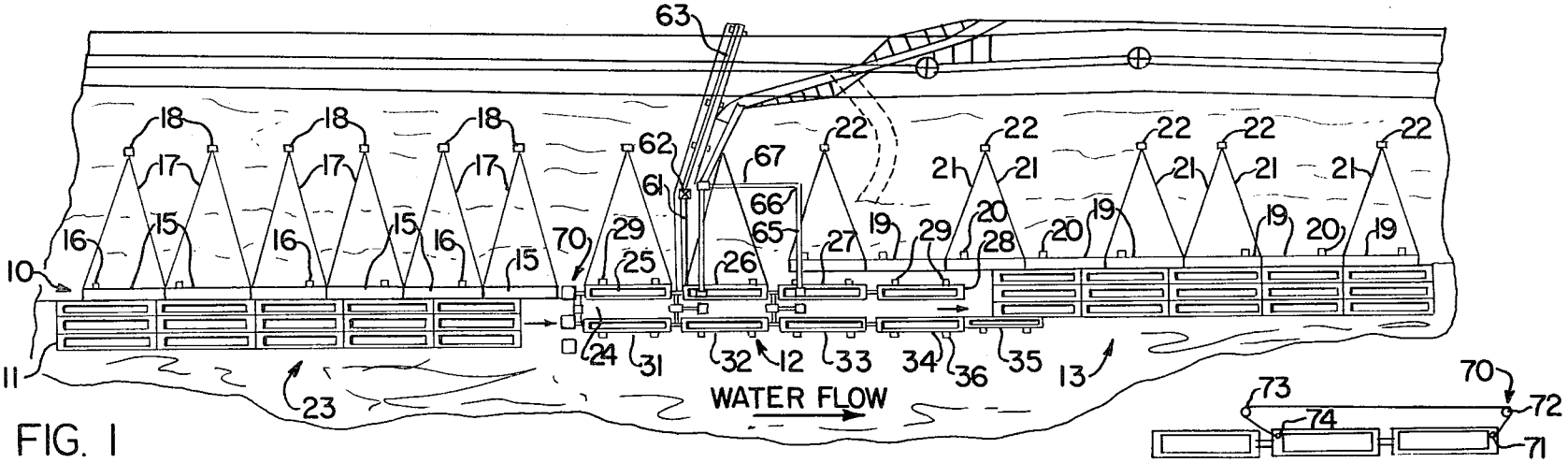
FIG. 1
FIG. 6
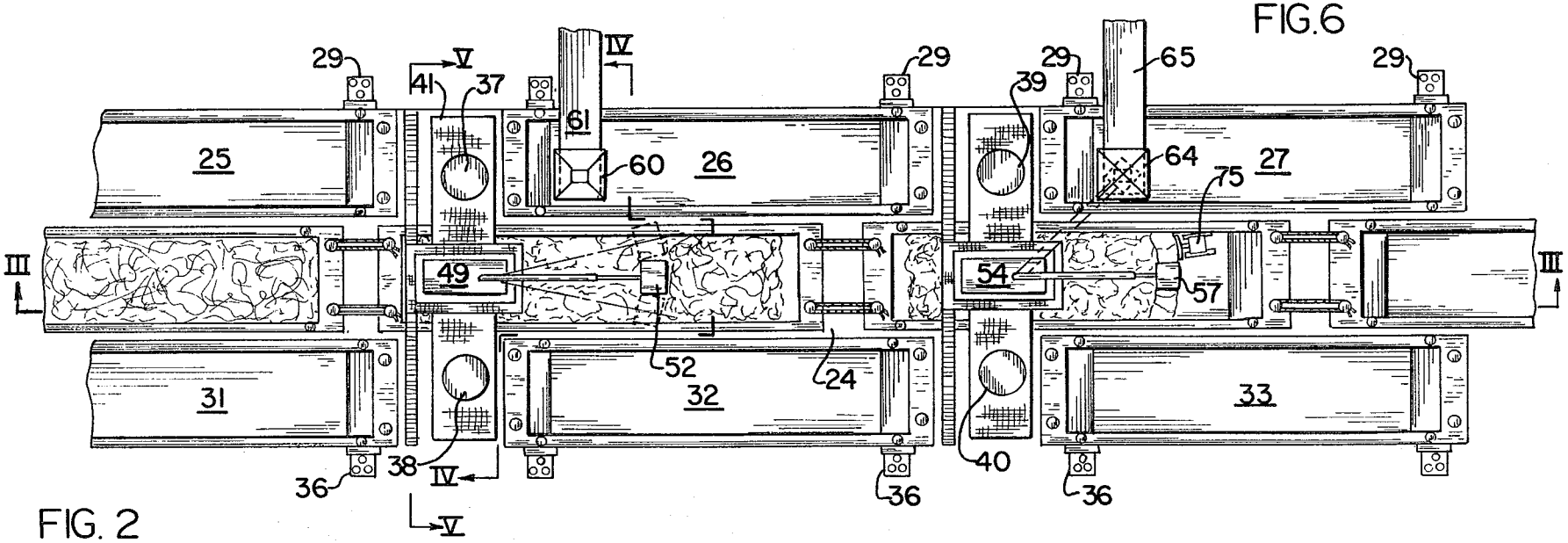
FIG. 2

METHOD AND APPARATUS FOR UNLOADING BURDEN FROM A TOW COMPRISED OF BARGES

BACKGROUND OF THE INVENTION

This invention relates to a method and apparatus for unloading the burden from a tow comprised of breast-tied strings of barges moored initially at an access platform where strings of barges can be formed with forward and aft soft ties to compensate for barge draft changes as the burden is removed in a floating unloading slip by two serially-arranged unloaders, preferably excavators. The burden is unloaded by initially removing an upper layer comprised of about 60% of the burden with the first of the unloaders and then the remaining layer of burden is removed by the remaining unloader. The last barge of the first string can be softly tied to the forward barge in a second string which is provided with soft ties at the access platform. As the first string of barges passes from the slip, they are separated from the second string and moved to an adjacent fleeting area where hard ties are again established between the barges of the first string as well as second and third strings of barges after being unloaded in the slip and placed abreast thereto.

As is known in the art, barges comprising a tow are usually made up of three strings, each comprised of five barges that are latched together in a forward-to-aft end relation with a wire rope, chain, etc. so that substantially no relative movement can occur between the individual barges in the string. The barges in the strings are latched together by hard-breast ties so that the barges in the strings form five tiers of three side-by-side barges. The connections between the barge tiers and strings are hard ties formed by wrapping steel cables, chains, etc. tightly between capstans by the use of a tensioning device such as a ratchet or winch.

In the known procedure, a tow is generally moored at a landing station where the hard ties are removed and each barge is moved to the location of an unloader where the barge is passed forwardly and backwardly beneath a ladder-type unloader or a continuous bucket elevator to unload the burden. A towboat or a barge haul is used to control back and forth movement of the barge at the unloader. The unloader is operated to remove the burden in layers. The first layer is removed from the barge in a first pass beneath the unloader. The towboat or barge haul is then operated to move the barge backwards whereupon the unloader is again positioned and operated to remove a further layer of burden. The cost for unloading a barge is of utmost importance; however the unloading operation is, as a practical matter, carried out by a two-pass operation. After each barge is unloaded, it is advanced to a clean-up area where residual amounts of burden are cleaned from the barge. Typically, for example, when a barge carries a burden of about 1500 tons, there is usually between 10 to 50 tons of residual burden left in the barge after unloading by the ladder or bucket unloader. The clean-up operation in each barge is a costly, time-consuming operation. Demurrage charges can be imposed for excessive unloading times. The clean-up operation is usually carried out by loading an appropriately-sized, self-contained scraper into the barge at the clean-up station and used in conjunction with a clamshell unloader to remove residual burden. The burden is either transferred into another barge for future unloading or delivered to a land-based storage pile by a truck. After the barges are completely emptied, they are moved to a fleeting area where a tow of empty barges is assembled.

Another conventional practice is to move barges in a string back and forth for two or more unloading passes. This is undesirable, on the one hand, because excessive rope slack to the forward and aft loose ties permits violent impacting between the aft and forward ends of the barges in the string; while on the other hand, inordinate amounts of time is consumed to back up the entire string so that the length of one barge can again move forward for a subsequent unloading pass. Two or more barge-unloading passes are necessary to maintain stability of the barge, prevent possible sinking and avoid destructive loading on the barge itself. Most barges used in the waterways in the United States today are of massive structures but lack an adequate reinforcement which will prevent breaking in half a barge when one-half is loaded with burden and the remaining half is empty. Moreover, should this loaded condition occur, the unequal load distribution may cause the loaded end of the barge to fall below the water level whereby the barge will ultimately sink. Some barge constructions are designed to withstand the forces that will be imposed when one-half of the barge is empty while the remaining half of the barge is loaded. However, the attitude of such a barge in the water at the unloader renders movement of the barge erratic and difficult to control.

In a conventional barge-unloading arrangement, when a barge is received in the slip with an inordinate amount of water mixed with the burden, such as coal, special measures are required to pump the slurry to a treatment area to recover the coal and clean the contaminated water. The slurry is removed from the barge at the clean-up area which further extends the time required to unload the barge and return it, or an entire string of barges, to a fleeting area.

Sometimes barge-unloading operations must be curtailed due to large fluctuations to the water level in a body of water which also places serious design constraints on the unloading apparatus. For example, there is as much as a 36-foot water level fluctuation on an annual basis to the Mississippi River. The water velocity also imposes design contraints on the apparatus to such an extent that conventional ladder unloaders can only be utilized with large capital expenditures for heavyduty equipment and massive support structures.

To overcome these deficiencies, the present invention provides a barge-unloading system which is more efficient than barge-unloading systems known in the art and avoids their shortcomings and drawbacks.

SUMMARY OF THE INVENTION

It is an object of the present invention to provide a barge-unloading system embodying a design and construction of parts to not only accommodate fluctuations to the water level at a barge-unloading site but also permit a continuous, unidirectional movement of the barges through an unloading slip.

It is a different object of the present invention to provide a barge-unloading system wherein a complete tow is landed at an unloading station and picked up as a complete tow after being unloaded at an adjacent fleeting area without diverting barges for a final clean-up before movement to the fleeting area.

More particularly, according to the present invention there is provided a method for unloading the burden from a hard-tied tow comprised of breast-tied strings of barges, the method including the steps of mooring a loaded tow to an access platform, releasing the hard ties on a first string of barges, directing the first string of barges into an unloading slip for passage under two serially-arranged unloaders, releasing the hard ties on a second string of barges at the access platform, unloading the burden in two layers of the serially-arranged unloaders each of which unloads one layer from each barge while normally passing in only one direction continuously through the slip, directing the second string of barges into the slip, unloading the burden in two layers in the same manner used to unload the barges in the first string, mooring the barges from the first string in a fleeting area after unloading in the slip, and mooring the barges from the second string abreast the moored first string after unloading in the slip.

In the preferred form of the method, the strings of barges at the access platform are formed with forward and aft soft ties between the barges of each string. Excavators are preferably used at spaced-apart locations above the unloading slip to unload the burden in two layers from each barge while moving substantially continuously in one direction along the unloading slip. About 60% of the burden is preferably removed as a first upper layer from each barge. Concurrently with the operation of the second of the serially-arranged unloaders, residual amounts of burden in the barge are pushed in an aft direction for removal by the second unloader, thus reducing the unloading time by eliminating the need for moving barges to and from a clean-up station as well as the set up and cleaning time at a cleaning station. The first and second strings of barges are preferably joined together by forming soft ties between the forward end of the second string of barges and the aft end of the first string of barges such that the barges continuously pass along the unloading slip. A barge haul or other forms of a winch is used to control movement of the barges along the slip. When the barges move with the water current, it is usually only necessary to retard advancing movement of a barge according to the present invention.

The present invention further provides an apparatus to unload the burden from a hard-tied tow of barges, wherein the apparatus includes the combination of an access platform for removing hard ties from the barges comprising said tow, means forming an unloading slip for guiding successive barges released from the access platform, two serially-arranged unloaders supported above the unloading slip for unloading the burden in two layers by the two unloaders each of which unloads one layer from each barge while normally passing in only one direction continuously through the slip, means for controlling movement of a barge along the means forming an unloading slip, and means for conveying the burden removed by the unloaders from the means forming an unloading slip.

These features and advantages of the present invention as well as others will be more fully understood when the following description is read in light of the accompanying drawings, in which:

FIG. 1 is a plan view of apparatus arranged in a manner to carry out the method of unloading barges according to the present invention;

FIG. 2 is an enlarged plan view of two serially-arranged unloaders above an unloading slip forming part of the present invention;

FIG. 6 is a schematic view to illustrate one form of a winch to control movement of barges along an unloading slip.

Figure 3:
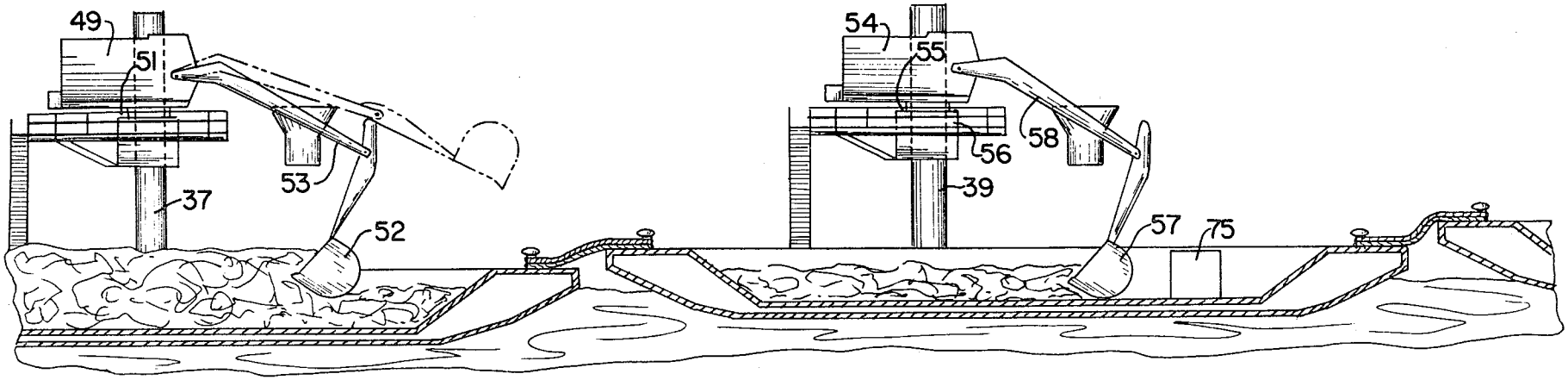
FIG. 3 is an enlarged side elevational view taken along line III—III of FIG. 2.

In FIG. 1, the combination of apparatus illustrated therein includes an access platform 10 forming a landing station for a complete tow 11 comprised of, for example, fifteen barges. Unloading of the barges occurs at an unloading station 12 from where the barges move to a fleeting area 13 where they are again hard tied to form a tow which is returned to a distally-located filling station by a tugboat. The entire unloading operation is preferably carried out with the use of barge hauls rather than towboats. The present invention permits coordination with river movements such that a downriver towboat can pick up an empty tow at the unloading station, for example, for an upstream trip, thus minimizing the area and time required for fleeting. In contrast to this, the prior practice was to move a loaded tow to a fleeting area where the hard ties connecting the barges together are removed and then one or two barges are transferred to an unloading station for several unloading passes. The time required for moving one or two barges, tieing and untieing operations, hooking up to barge hauls or winches and starting up operations for the return travel varies with the distance to the fleeting area which can be considerable and represents a substantial expense.

When the present invention is carried out for unloading a tow on a moving body of water, such as a river, the access platform 10 is preferably situated upstream of the unloading station 12 with the fleeting area 13, preferably situated downstream of the unloading station. The access platform 10 at the landing area is preferably made up of a string of access barges 15 arranged forward-to-aft and breasted against dolphins 16. The access barges 15 are retained shoreward by lines 17 formed by heavy chains or cables extending to deadmen 18. The length of moored access barges 15 is selected to preferably exceed the length of a string of barges forming a tow. For example, a tow on the Mississippi River is usually comprised of at least fifteen barges arranged with five barges in each string tiered three abreast. When the burden in the tow is coal, for example, each barge usually carries about 1500 tons for a total of 22,500 tons per tow. By the use of the present invention, unloading the tow can be carried out in about fourteen hours as compared with thirty hours or more for a typical unloading operation of a tow using known unloading procedures.

At the fleeting area 13, there is a string of shoreward-situated access barges 19 forming an access platform. The barges 19 are breasted against dolphins 20 and retained shoreward by lines 21 such as a chain or cable extending to deadmen 22. The string of access barges 19 at the fleeting area extends along the length of the shoreline which is substantially greater than the length of a string of access barges 15 at the unloading station for greater access. The preferred embodiment of the present invention provides for the continuous unloading of barges comprising a full tow while moving normally in one direction which reduces the requirement for fleeting of full and empty barges. The facilities for fleeting barges in the past generally included inspection facilities and a sufficient area to fleet 80 to 100 barges within the general vicinity of the unloading area. With the use of the present invention, the requirement for this large fleeting area is not necessary, although it is desirable to provide a mooring space for a plurality of empty tows to assure continued availability of the fleeting area 13 for unloading successive tows.

As shown in FIG. 1, the unloading station 12 is situated between the access platform 10 which forms a landing station 23 for mooring a loaded tow and fleeting area 13 for forming a hard-tied empty tow. The unloading station includes an endless slip 24 formed by a shoreward string of barges 25, 26, 27 and 28, each of which is moored against two dolphins 29 and retained shoreward by lines 30 attached to deadmen. An openended channel is formed between barges 25–28 and barges 31, 32, 33, 34 and 35. Barges 31–35 are each moored against pairs of spaced-apart dolphins 36.

Figure 4:
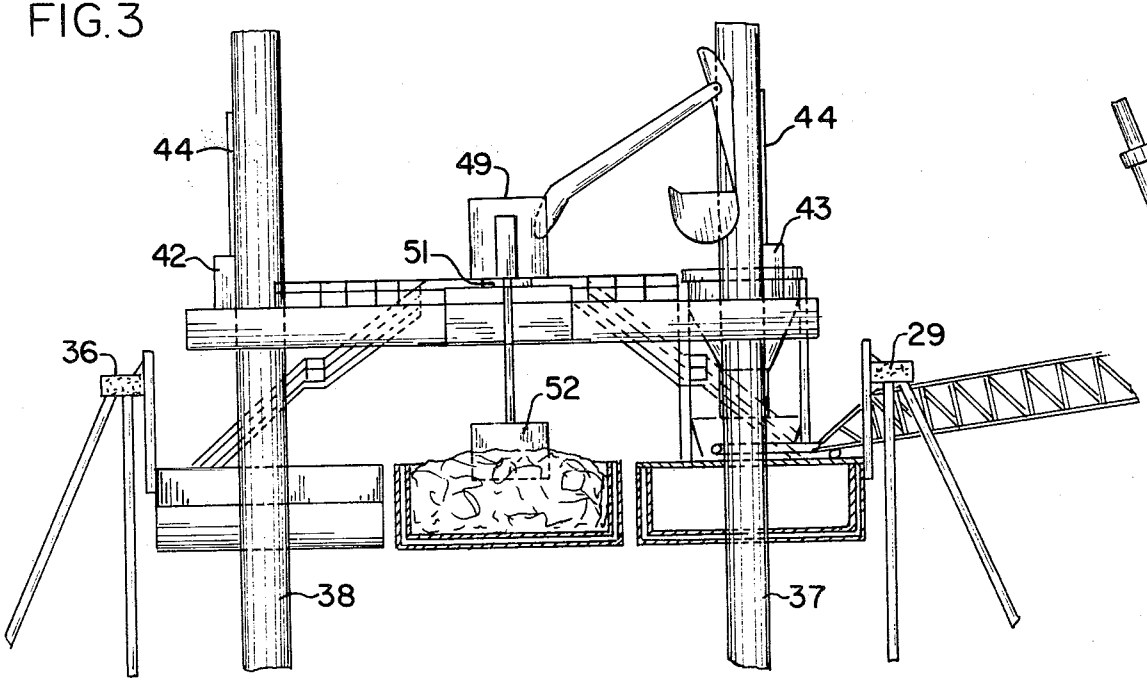
FIG. 4 is an enlarged end view taken along line IV—IV of FIG. 2.
Figure 5:
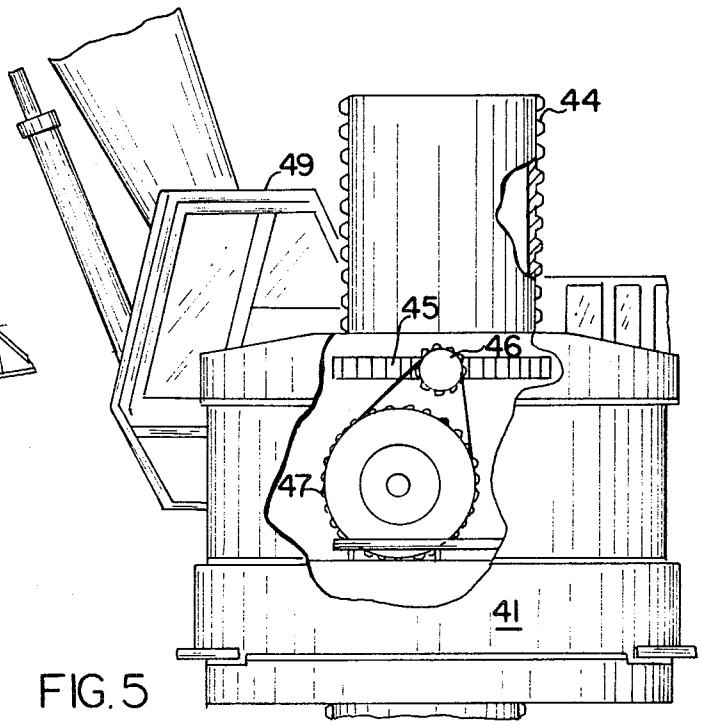
FIG. 5 is an enlarged partial view of a platform drive system used to adjust the height of the barge unloaders.

As shown in FIGS. 2, 3 and 4, pile supports 37 and 38 extends vertically in a space between the ends of barges 25 and 26 and 31 and 32, respectively. Similarly, pile supports 39 and 40 extend vertically in a space between barges 26 and 27 and 32 and 33, respectively. Extending between the pile supports 37 and 38 is a horizontally-arranged platform 41. Gear drives 42 and 43, each mounted on the platform 41, engage rack members 44 on the respective pile supports for raising and lowering the platform through operation of the gear drive. Each gear drive, as shown in FIG. 5, includes a ring gear 45 driven by a pinion 46 which is, in turn, driven by a chain extending to a gear reducer 47. Gear reducer 47 is driven by a motor, not shown. The platform 41 spans the slip and is adjusted to an elevation such that loaded barges can pass beneath the platform. The platform carries, in a preferred form of the present invention, a hydraulically-powered excavator 49, per se, known in the art. A trunnion 51 supports the excavator for pivotal movement about a vertical axis on the platform such that an excavator bucket 52 carried by a linkage 53 can be moved from side-to-side to remove the burden across the width of a barge in the slip.

As shown in FIG. 3, excavator 49 forms one of two serially-arranged excavators along the slip. Excavator 54, being the second excavator located downstream of the first, is supported by a trunnion 55 for movement about a vertical axis upon platform 56. Platform 56 is raised and lowered by drives constructed in the same manner as drives 42 and 43. Excavator 54 has a bucket 57 connected by a linkage 58. The elevation of platforms 41 and 56 is adjusted according to the prevailing water level and to assure that bucket 52 can operate to remove an upper layer of burden from a barge after which bucket 57 can remove the remaining layer of burden in that barge, as will be described in greater detail hereinafter.

As best shown in FIGS. 1 and 2, barge 26 at the shoreward side of excavator 49 carries a hopper 60 to direct the burden which is emptied from a barge by the excavator onto a conveyor 61 which is used to carry the burden to a surge hopper 62 on the shore. The surge hopper transfers the burden to a discharge conveyor 63. Barge 27 carries a hopper 64 arranged to receive the burden removed from a barge by excavator 54 and delivered by a conveyor 65 to a transfer point 66 where a further conveyor 67 delivers the burden to surge hopper 62. A barge haul or winch 70 is arranged on the shoreward barges of the unloading slip where one end of a rope hitch 71 engages a barge at the entry end of the slip to control movement of the barge along the slip. A winch cable extends about a pulley 72 to a winch 73. A rope hitch 74 engages an upstream barge in the string. While the length and width of the barges making up a tow are usually uniform, the depth, draft and rakes at the forward and aft ends of a barge vary from barge-to-barge. For example, when a 1500-ton burden is unloaded from a coal barge, the barge will rise in the water by a distance of between 9 to 10 feet when empty. To facilitate the use of two serially-arranged excavators, strings of softly-tied barges are formed to compensate for draft changes as each barge in a string is unloaded while passing continuously in one direction through the unloading slip. Consecutive barges in the slip will be in a full, half-full, and empty relation, thereby minimizing a draft difference between barges to only about 4½ feet. Soft ties are formed by wrapping a line, usually Manila rope, between capstans on each barge so that rope slack always exists between barges during unloading to accommodate the draft differences.

As described previously, it is preferred to arrange the barge-unloading system with the landing area upstream of the unloading slip and fleeting area. This allows movement of the barges through the slip while controlled by the barge haul which functions essentially as a retarder. The barge haul can, of course, be operated to retract barges from the slip should an emergency situation occur. The rake across the end of the barges when secured by soft ties and propelled by a barge haul could allow one barge to slip under a preceding barge if it had a rake rather than a square end. This problem is, however, eliminated by allowing for downstream movement of the string of barges. Furthermore, it is advantageous to arrange the unloading slip downstream of the loading area since it facilitates the digging action of the excavator pushing against the burden. Moreover, hard impacts between barges in the strings are eliminated, particularly while they move through the slip.

It is further advantageous to arrange for movement of barges through the slip with the current since movement of emptied barges downstream facilitates tie-up operations at the fleeting area against the access platform. Movement of emptied barges from the slip counter to the current requires a winch system or barge haul representing an added expense. Another factor of importance is the fact that a downstream line towboat must make a 180° turn to arrange the tow in position. In rivers of the United States, there is always a possibility of collison with on-coming traffic because of the time required to make the turn and the line-of-sight is poor due to circuitous river directions.

In carrying out the method of the present invention, a tow comprised of strings of breast-tied barges, landed by operation of a tug, is moored abreast of barges 15 at the access platform 10. In this operation, the tow is spotted by the line tug alongside the barges The barges 15 which are tied to the dolphins are capable of vertical movement as the water level fluctuates. After the tow is secured to the landing platform, typically by the use of breasting cables on winches, the shoreward string of loaded barges, typically five in number, have their hard ties fore and aft replaced with soft ties. The breasting cables between the first string of softly-tied barges are removed to separate the string from the access platform as well as from the hard-tied strings of barges outwardly therefrom. The end of the remaining hard-tied barges at the access platform is retained to prevent movement of these barges toward the slip such that only the soft-tied first string of barges passes toward the unloading slip where a barge haul is engaged with the barge which is leading the string. As the first string of barges enters the slip and undergoes unloading therein, the remaining two strings of hard-tied barges are pulled shoreward against the barges of the access platform where the shoreward string of the remaining barges undergoes processing by replacing the hard ties in a second string with soft ties. As the trailing barge of the first string of barges enters the unloading slip, the leading barge of the second string is softly tied to the first string such that, in its preferred form, an essentially-continuous line of barges moves through the unloading slip. While the second string of barges undergoes unloading in the slip, the third string of barges at the access platform is pulled shoreward against the platform where the barges are breast-tied to the platform while the hard ties of the third string are replaced with soft ties. As the trailing barge of the second string enters the slip for unloading, the leading barge of the third string is connected to it by soft ties. The breast lines to the third string of barges are released from the access platform to permit advancement of the string into the unloading slip.

The barges of the strings are unloaded in the slip by operating the two serially-arranged excavators to remove the burden in two layers from each barge. Thus, the first barge in the first string is normally passed in only one direction continuously through the slip where the first of the two serially-arranged excavators is operated to remove an upper layer of the burden, preferably comprised of about 60% of the burden. The barge continues forward movement to the second of the two serially-arranged excavators where the remaining layer of burden is removed. Each of the excavators operates to place the burden removed from the barges into the hoppers carried on the barges which form the unloading slip for transportation by conveyors as described above. As can be seen in FIG. 4, when a leading barge undergoes its final unloading of the burden, it rides higher in the water because of the decreased weight of burden. After the burden in the forward part of the leading barge has been removed, a small scraper-type bulldozer 75 is placed in the barge by operation of a crane. The scraper is used to move residual amounts of burden remaining in the barge in an aft direction for removal by operation of excavator 49. This eliminates the time-consuming clean-up operation at a separate area and permits the unloaded string of barges to be moved directly to a fleeting area. After the barge has been unloaded through the use of excavator 49, the scraper 75 is lifted from the barge and placed in the next succeeding barge after it has advanced a suitable distance beyond the operating site of bucket 57. As the first string of barges emerges from the unloading slip empty, a mooring procedure is followed which is similar to the operation at the access platform but in reverse. The first string of barges is moored against the access platform at the fleeting area where hard ties are formed between the forward and aft ends of the barges in place of the soft ties. The second string of barges, when empty, is moved abreast of the first string where the soft ties in the second string are replaced with hard ties and the second string is joined to the first string by hard-breast ties. The procedure is repeated for the third string of barges when it emerges from the unloading slip. A tow of empty barges is then ready for a return trip with a tug.

It is to be understood that movement of barges during the unloading operation is preferably carried out by the use of winches and barge hauls; however a work tug can be used for this purpose. In the unloading operation, inordinate amounts of water sometimes accumulate in barges which must be removed by slurry pumps. This can be achieved while an unloaded barge proceeds from the second of the serially-arranged excavators and before the barge passes from the unloading slip. While two serially-arranged excavators have been described hereinbefore for unloading the burden from barges, it is apparent that two pairs of serially-arranged excavators can be used and supported in the same manner along the one unloading slip. Suitable excavators presently available are Koehring Model 1466D, Bucyrus Erie Model 500H and DeMag Model H121. Such excavators can be diesel-powered or electric.

The unloading time for each barge is typically forty minutes whereby the unloading time of a 15-barge tow requires ten hours. The time for landing a tow and changing ties for one string is about one hour. The time to provide hard ties for a complete empty tow is about two hours, whereby given an allowance of an additional hour for miscellaneous procedures in the unloading process, the total time for unloading a 22,500-ton tow is about fourteen hours which is comparable to about thirty hours required for unloading a similar tow using known procedures. In view of the foregoing, it is also apparent that more than one tow can be landed at an access platform and strings of softly-tied barges can be continuously fed into each of two parallel unloading slips. In this event, both of the slips are provided with serially-arranged excavators that can remove the burden from the barges into an integrated system of conveyors through the use of hoppers on barges alongside each slip.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A method for unloading the burden from a tow comprised of breast-tied strings of barges, said method including the steps of:

mooring a loaded tow to an access platform, releasing hard ties from a first string of barges, forming forward and aft soft ties between barges of said first string at said access platform, directing the first string of barges into an unloading slip for passage under two serially-arranged unloaders, releasing hard ties from a second string of barges of the remaining moored barges at the access platform, forming forward and aft soft ties between barges of said second string at said access platform, arranging said unloaders at spaced-apart locations above said unloading slip to substantially remove one layer of burden from one barge before unloading the final second layer of burden to thereby maintain each barge at a stable, vertical attitude while passing through said unloading slip, unloading the burden in two layers by the use of said two serially-arranged unloaders from each barge comprising said first string of barges while normally passing in only one direction continuously through said slip, directing said second string of barges into said slip, unloading the burden in two layers by the use of said two serially-arranged unloaders from each barge comprising said second string of barges while normally passing in only one direction continuously through said slip, mooring said first string of barges at a fleeting area after unloading in said slip, and mooring said second string of barges abreast of said first string of barges after unloading in said slip.

2. The method according to claim 1 in which said step of unloading the burden in two layers is further defined to include removing about 60% of the burden as a first upper layer.

3. The method according to claim 1 including the further step of pushing residual amounts of burden in an aft direction of a barge in said unloading slip for removal by the second of said two serially-arranged unloaders.

4. The method according to claim 1 including the further step of coupling said first string of barges with a barge haul to control passage of said first string in said unloading slip.

5. The method according to claim 1 including the further step of forming soft ties between the forward end of said second string of barges and the aft end of said first string of barges for continuous passage of barges in said unloading slip.

6. The method according to claim 1 wherein said step of mooring said first string of barges includes forming forward and aft hard ties between the barges of the first string, and wherein said step of mooring said second string of barges includes forming hard ties forward and aft between the barges thereof, and hard-breast ties between barges comprising said first and second strings.

7. The method according to claim 1 wherein said unloaders comprise excavators.

8. Apparatus to unload the burden from a tow comprised of breast-tied strings of barges, said apparatus including:

an access platform for removing hard ties from the barges comprising said tow, means forming an unloading slip for guiding successive barges released from said access platform to pass normally in one direction through the slip while connected together by soft ties, two serially-arranged unloaders supported above the unloading slip at spaced-apart locations therealong for unloading the burden in two layers each by the use of one of said unloaders from each barge while normally passing in only one direction continuously through the slip, the space between said unloaders being suffiient for substantially removing one layer of burden from one barge before removing the final second layer, means for controlling movement of a barge along said means for forming an unloading slip, and means for conveying the burden removed by said unloaders from said means forming an unloading slip.

9. The apparatus according to claim 8 further including pile supports extending vertically at opposite sides of said means forming an unloading slip, spaced-apart platforms supported by said pile supports, and means on each platform for supporting one of said two serially-arranged unloaders for movement about a vertical axis.

10. The apparatus according to claim 9 further including drive means for adjusting the height of said platforms above said means forming an unloading slip.

* * * * *